United States Patent [19]

Goris et al.

[11] 4,181,363

[45] Jan. 1, 1980

[54] MINING METHOD AND MINING MACHINE FOR CUTTING AWAY HARD MINERAL MATERIALS

[75] Inventors: Heinrich Goris, Hamminkeln; Roland Günther, Wesel; Kurt Ogorek, Oberhausen; Karl-Heinz Schwarting, Voerde; Wilfried Witulski, Unna, all of Fed. Rep. of Germany

[73] Assignee: Gutehoffnungshütte Sterkrade A.G., Fed. Rep. of Germany

[21] Appl. No.: 890,953

[22] Filed: Mar. 28, 1978

[30] Foreign Application Priority Data

Mar. 29, 1977 [DE] Fed. Rep. of Germany ..... 2713781

[51] Int. Cl.[2] ..... E21C 27/34; E21C 25/60

[52] U.S. Cl. ..... 299/17; 299/34; 299/81

[58] Field of Search ..... 175/67, 422; 299/15, 299/17, 81, 34, 22

[56] References Cited

U.S. PATENT DOCUMENTS

| | | | |
|---|---|---|---|
| 1,637,531 | 8/1927 | Morgan | 299/22 X |
| 3,151,912 | 10/1964 | Herrmann | 299/34 |
| 3,542,142 | 11/1970 | Hasiba et al. | 175/422 X |
| 3,758,160 | 9/1973 | Hilton | 299/15 |
| 3,924,698 | 12/1975 | Juvkam-Wold | 175/422 X |

FOREIGN PATENT DOCUMENTS

| | | | |
|---|---|---|---|
| 1274544 | 8/1968 | Fed. Rep. of Germany | 299/34 |
| 2406893 | 9/1974 | Fed. Rep. of Germany | 299/17 |
| 672336 | 5/1952 | United Kingdom | 299/17 |

*Primary Examiner*—Ernest R. Purser
*Attorney, Agent, or Firm*—McGlew and Tuttle

[57] ABSTRACT

A mining method for cutting away hard mineral materials of a mining face, comprises, undercutting the mineral material by directing a liquid jet into the running face to form a mineral slab which overlies the undercutting and breaking the bond of the slab from the main face by striking it with a wedge-shaped impact tool in the undercut area and conveying away the broken-off material. The apparatus for carrying out the mining operation comprises a machine which is adapted to run along the mining face alongside a conveyor for conveying away the material. The machine includes an operating mechanism for moving a breaking head at each end inwardly into the mine face and along the mine face. The breaking head carries a percussion wedge member which may be driven into the mine face. In addition, it carries a nozzle assembly for directing a liquid jet at high pressure against the mining face so as to undercut an area thereof and to leave a slab overlying the undercut area which may be broken away by the wedge-shape percussion member.

21 Claims, 21 Drawing Figures

MINING METHOD AND MINING MACHINE FOR CUTTING AWAY HARD MINERAL MATERIALS

FIELD AND BACKGROUND OF THE INVENTION

This invention relates to underground mining in general, and, in particular, to a new and useful mining method and to a device for carrying out mining for a combined hydraulic and mechanical extraction of principally hard mineral raw materials.

DESCRIPTION OF THE PRIOR ART

A hydromechanical coal planer for longwall workings, comprising, at least one high pressure water nozzle is known from German Auslegeschrift No. 1,274,544. The pressure at the nozzle amounts to approximately 300 atm. During the mining operation, the nozzle is moved along the vertical plane of the coal face in such a manner that the curve traced by the water jet covers the entire working height of the coal. The planar body is provided with a fixedly secured bottom blade and with rigid bits.

A device for hydromechanically extracting a seam-like deposit divided by a system of passageways into panels is known from German Auslegeschrift No. 2,307,413. The device comprises a single, shield-like supporting element which is open to the working face and in which fixed high-pressure nozzles are mounted which are distributed over the entire length of the working face. In this supporting element, a mechanism, provided with high-pressure nozzles, is guided while it makes incisions in the working face, such as are usually sheared by the planer with the aid of the bits. The extracted material is carried away with the aid of flush nozzles.

None of the mentioned prior art devices appears to be suitable for extracting hard minerals at tolerable expenses.

The hydromechanical coal planer of German Auslegeschrift No. 1,274,544 operates with a water pressure which is too small for a hard material to make a sufficiently deep incision in the face, so that the mineral must subsequently be dislodged by means of the planer equipped with rigid bits.

According to the teaching of the above-mentioned German Auslegeschrift No. 2,307,413, the minerals are extracted by means of a plurality of cutting nozzles, without the aid of a peeling tool. There is no teaching of the use of water pressure for operating the nozzles. Should the nozzles operate with large amounts and at a low pressure, for example, of 300 atm, it is to be expected that the material will be obtained in the form of mud, provided that the planer will be capable of operating at all, in view of the relatively low water pressure, to extract a satisfactory amount of material. If, on the other hand, the material is extractable in satisfactory amounts by means of high water pressures, the power consumption for producing the high water pressure will be uneconomically high.

SUMMARY OF THE INVENTION

The present invention is directed to a method and device which is suitable for a hydraulic and mechanical extraction of principally hard raw mineral materials, which would be an appropriate modification and development of known basic elements. The principle of the invention is to coordinate the cooperation of a hydraulic cutting tool with a mechanically actuated breaking tool in a manner such that the dislodging operation, subdivided into partial operations of cutting and breaking, is adjustable to the hardness of the mineral, with the result of obtaining a maximum amount of extracted material, while consuming a minimum amount of power.

At the same time, this result is achieved without adding difficulties to the mining operation, without making necessary additional provesses in the further treatment of the extracted material, and without increasing labor costs.

The invention begins with the realization that to solve the problem posed, a novel arrangement relative to each other of the partial operations of the process of extraction is needed. To this end, the partial operations of undercutting and breaking off must be timed relative to each other. This is made possible, in accordance with the invention, by providing a continuous extraction in which the material is undercut with an adjustable lead over of the breaking off operation.

The partial operation of undercutting depends on the hardness of the material and, for this reason, in accordance with a further feature of the invention, the pressure and amount of the high pressure water for undercutting must be adjustably adapted to the hardness of the mineral.

Another means for adapting the extraction to the hardness of the material, in accordance with the invention, is that the undercutting of the material is effected with a single nozzle, or, if the material is very hard, with a plurality of nozzles.

The partial operation of breaking off also depends on the hardness and, in addition, on the cohesive forces of the structure of the mineral substance. The extraction is to be adapted to these structural conditions. This is done, in accordance with the invention, by providing that the undercut mineral is broken off by means of a wedge-shaped breaking tool executing percussing or pivotal movements with an adjustable percussion or pivotal force. The partial operation of removing the extracted mineral is performed in a known manner, with the aid of the usual means of transportation.

The inventive mining method is also suitable for adapting to the intended manner of exploitation in that the mineral face may be worked in only one direction or in both directions, in which latter case, a nearly double amount of mineral can be extracted with relatively little additional equipment.

In accordance with another feature of the invention, the mining method may be adaped to the thickness of the mineral bed by providing that seems having a small thickness are extracted by means of a single-deck mining machine, while thick beds are extracted by means of a multiple-deck machine.

The mining method for a combined hydraulic and mechanical extraction must also be capable of complying with additional requirements exceeding the purely technological process. Also concerned are requirements relating to the health and safety of the crew and to the further treatment and use of the mineral following the extraction.

The inventive method contributes to the fighting of explosions in fiery mines by providing, in accordance with a further feature of the invention, that during the operation of undercutting the mineral, the pressure and the amount of the high-pressure water can be rated and adjusted so as to prevent ignition sparks from being produced. An ignition of the gas escaping during the undercutting of the mineral is effectively prevented by the extreme pressure liquid jet.

A substantial improvement of the working conditions of the crew is obtained with the inventive mining method by providing the possibility of adjustably rating the pressure and amount of the extreme pressure liquid jet during the undercutting, in a manner such that as little mineral dust as possible is produced by the cutting operation.

This dust-fighting contribution of the inventive method is substantially more effective than the usual expensive methods of face impregnation. The combined hydraulic and mechanical method makes it further possible to determinatively influence the properties substantial for the treatment or preparation of the extracted material, more particularly, the coarseness and water content. This advantage of the method is important particularly for the extraction and further treatment of coal, since coal mud and coal dust are more expensive in their transformation into a marketable product than are chunks, for example.

According to another feature of the invention, the lumpiness of the extracted material may be influenced by providing that during the undercutting operation, the thickness of the mineral slab to be separated is adjustably adapted to the designed coarseness of the material.

To prevent the production of greater amounts of very fine-grained muddy material, the method may additionally be improved, according to a further feature of the invention, by providing that during the undercutting operation, the pressure and the amount of the extreme pressure liquid are controlled so as to not exceed the water content admissible for the subsequent treatment.

To carry out the mining method of the invention, a machine is provided which comprises a cutting and breaking head on one or both of its front sides, which accommodates a nozzle assembly as the cutting tool for the undercutting, and a breaking tool for breaking off of the mineral to be extracted.

For the efficiency of the mining method, it is substantial that the cutting operation is performed in advance of the breaking operation. This is made possible, in accordance with the invention, by providing an intrinsically safe time relay, by means of which, the nozzle assembly can be adjustably switched on in advance of the switching-on of the breaking tool.

In accordance with the invention, the nozzle assembly for undercutting the mineral comprises, a nozzle secured to a swivel pipe, a displacement element for the swivel pipe, a connecting element provided between the swivel pipe and the drive thereof, a swivel pipe-side coupling element carried by the connecting element, a coupling rod, a driveside coupling element, a swivel drive with a displacement member, and a liquid feed conduit.

Due to an oscillatory motion of the swivel pipe about its own axis, the nozzle jet shears a vertical slot into the mineral. This undercutting jet, performing an oscillating motion, is produced due to the fact that, in accordance with the invention, the axis of the nozzle secured to the swivel pipe forms an angle of inclination of 90° less than 180° with the longitudinal axis of the swivel pipe. The effectiveness of the extreme-pressure liquid jet at the nozzle depends to a great extent on the sufficiently high pressure of the liquid which, in accordance with the invention, is adjustable and readjustable by the control mechanism of the pump.

The partial operation of breaking follows the undercutting of the mineral and is effected, in accordance with the invention, by means of a striking wedge executing percussing movements or of a pivoting wedge executing pivotal movements. The mining machine further makes it possible to appropriately adjust and to keep the desired thickness of the extraction slab, i.e., the advance of the workings and the position in height of the cutting and breaking heads between the roof and the floor.

In accordance with the invention, the mining machine includes both an actuating mechanism for adjusting the working advance by means of horizontally displaceable advance elements, and adjusting the cutting and breaking heads in height between the roof and the floor by means of adjusting elements.

Accordingly, it is an object of the invention to provided an improved method of mining which comprises, undercutting the face of the mine so as to form a slab over the undercut area by directing a jet of liquid at high pressure against the face, and breaking off the area wich has been undercut by directing a percussion wedge into the undercut part and collecting and conveying away the broken off material.

A further object of the invention is to provide an apparatus for cutting away hard mineral materials of a mine which comprises a housing which is adapted to move along a conveyor for conveying away the material and which includes a pair of breaking heads which are mounted for movement in an outward direction and which carry nozzle assemblies for directing high pressure jets into the mining face to undercut an area and which also includes a percussion wedge which is movable with the heads into the undercut area to break away the undercut overburden and deliver it to the conveyor for carrying it away.

Another object of the invention is to provide a mining machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
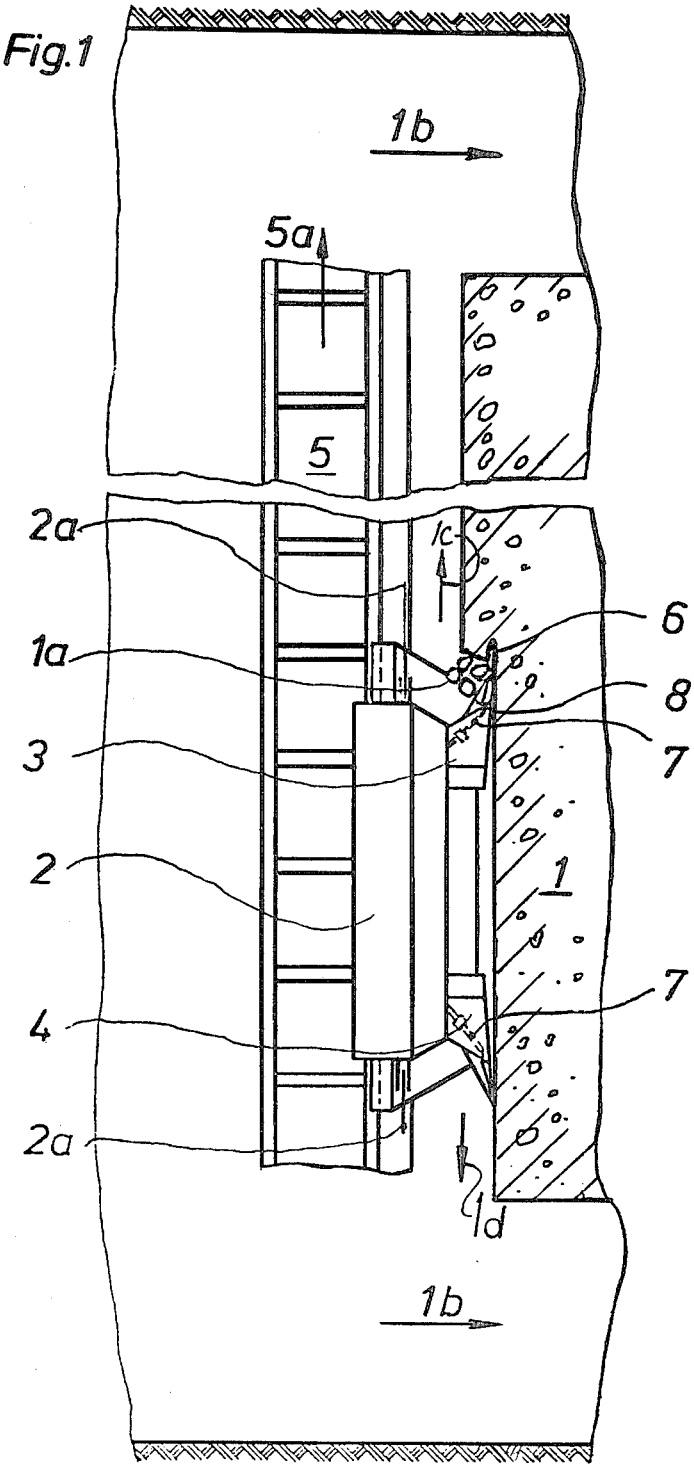
FIG. 1 is a top plan view of a mining machine constructed in accordance with the invention, as installed in the workings.

Referring to the drawings in particular, the invention embodied therein, comprises, a method and apparatus for removing particularly hard mineral materials from a mine, using a mining machine 2, which is adapted to be guided along a working mine face 1, alongside or overlying a continuous conveyor 5 for carrying the material off in the direction of the arrow 5*a*, as shown in FIG. 1.

In accordance with the method of the invention, during a first cut in the working face 1, the material to be extracted 1*a* is undercut, by way of an incision 6 and by means of a mining machine 2, using its nozzle assembly 7 accommodated in a cutting and breaking head 3 and 4 at respective ends thereof. The machine 2 includes a breaking tool 8 accommodated in each of the cutting and breaking heads. The material is dislodged from the face and transferred to a conveyor means 5 for being removed in the direction 5*a*.

Upon termination of the first cut in the direction indicated by an arrow 1*c*, the mining machine 2 is advanced by a step in the workings advance direction, designated by the arrow 1*b*, for carrying out a second extraction cut in an opposite direction, indicated by an arrow 1*d* from the direction 1*c* by means of cutting head 4. The extracted material 1*a* is again removed by means of conveyor equipment 5 in the direction 5*a*.

This extracting operation with the mining equipment continues up to a complete exploitation of the working face 1. The mining machine 2 is moved along the face or wall by means of a cable 2*a* and a winch (not shown) and is guided on conveyor means 5.

Figure 2:
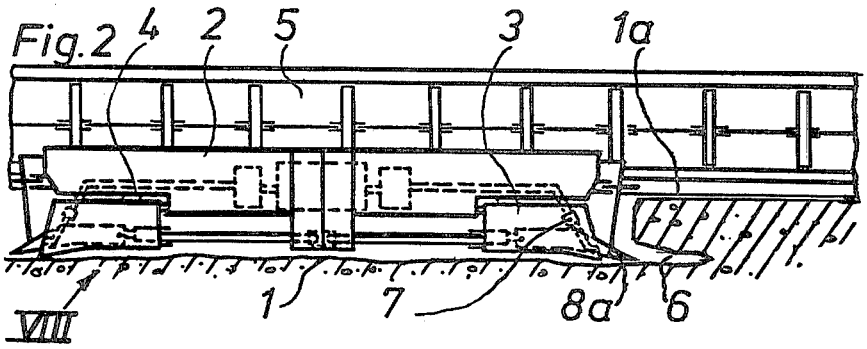
FIGS. 2 to 4 are views similar to FIG. 1, showing the mining machine equipped with a percussing wedge as the breaking tool.

FIGS. 2 through 7 illustrate the continuous extracting operation comprising the partial operations of "undercutting" the mineral 1*a* by means of the nozzle assembly 7 operated with an extreme-pressure liquid, and "breaking" by means of the breaking tool 8. FIG. 2 shows how an incision 6 is made by undercutting the mineral 1*a* by means of nozzle assembly 7 carried along in the cutting and breaking head 3.

Figure 3:
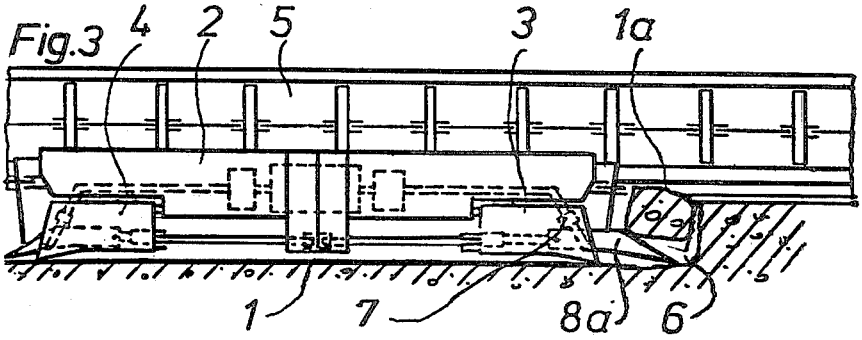
Figure 4:
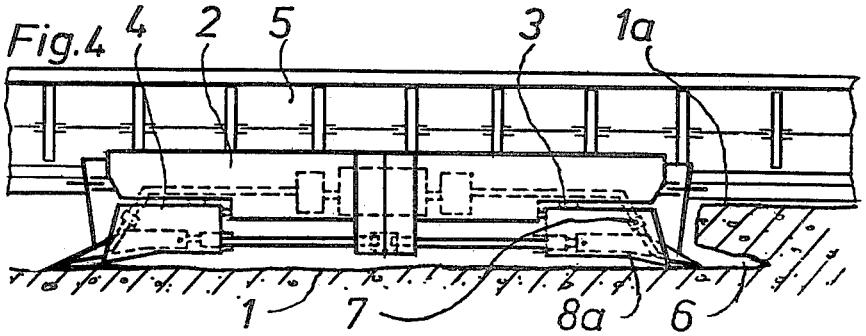

FIG. 3 shows how the breaking tool 8, designed as a percussing wedge 8*a*, penetrates into the incision 6 made by nozzle assembly 7, and how the mineral 1*a* is broken off the face by percussing wedge 8*a*, and FIG. 4 shows how another incision 6*a* is made by means of nozzle assembly 7.

Figure 5:
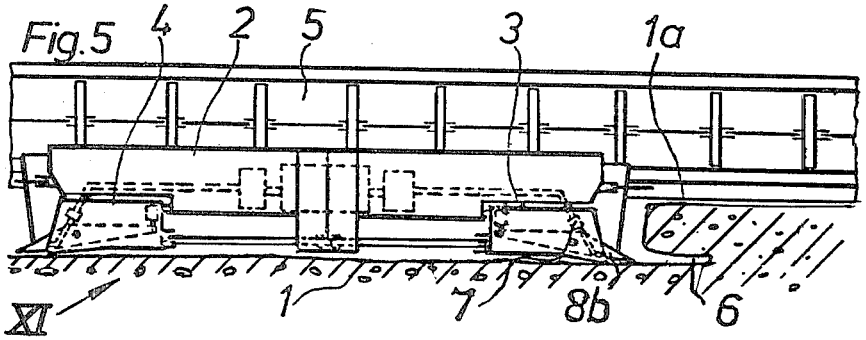
FIGS. 5 to 7 are views similar to FIG. 1 showing the mining machine equipped with a pivotal wedge as the breaking tool.
Figure 6:
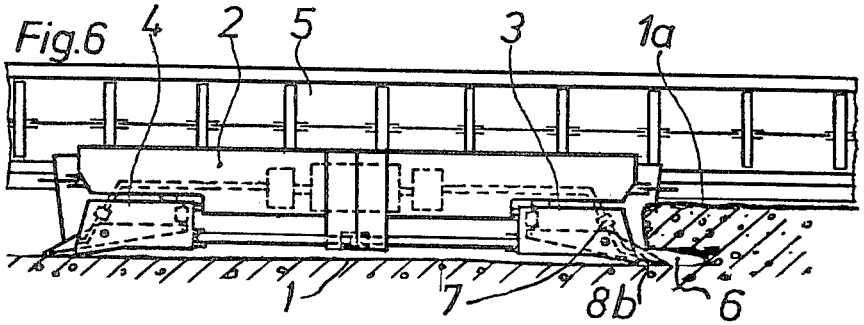
Figure 6A:
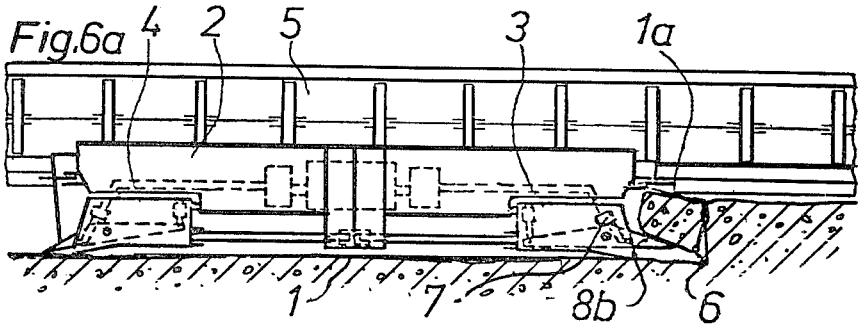
Figure 7:
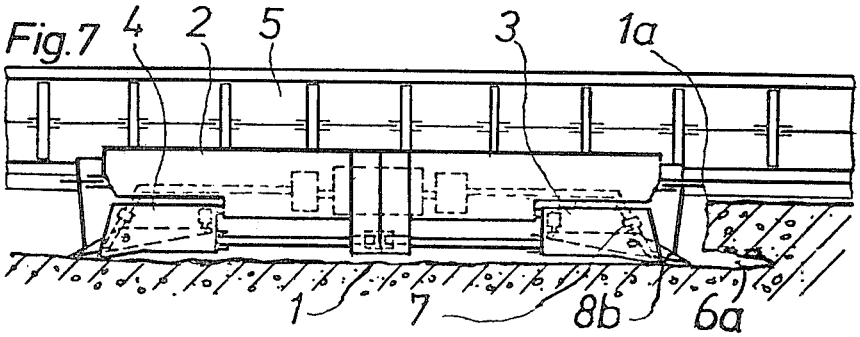

FIGS. 5 to 7 illustrate the extracting operation of "undercutting" and "breaking", in which the mineral is broken off by means of a pivotal wedge 8*b*. As shown in FIG. 5, an incision 6 is made by undercutting the mineral by means of nozzle assembly 7. As shown in FIG. 6, pivotal wedge 8*b* then penetrates into incision 6 and, due to its pivotal motion indicated in FIG. 6*a*, pries the material 1*a* out of the face.

FIG. 7 shows the termination of the partial operation "breaking" and the new incision 6*a* made, in the meantime, by means of nozzle assembly 7.

Figure 8:
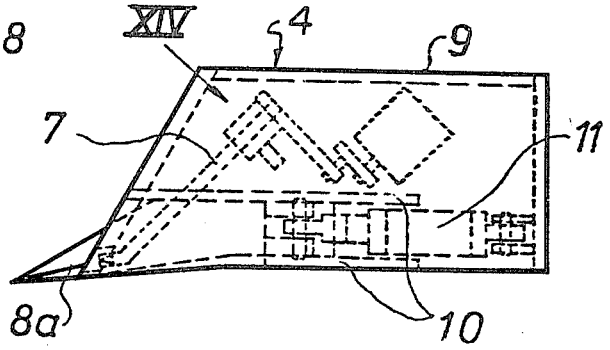
FIG. 8 is a top view of a detail indicated by arrow VIII in FIG. 2, showing the cutting and breaking head with a percussing wedge.
Figure 9:
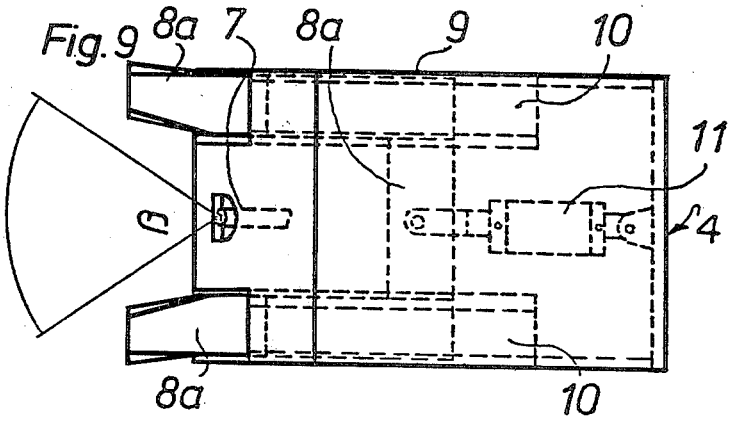
FIG. 9 is a detail according to FIG. 8, in a side elevational view, in which the percussing wedge is retracted.
Figure 10:
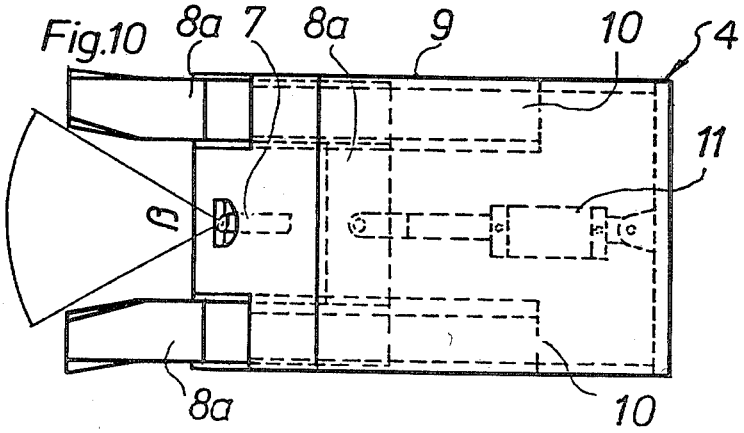
FIG. 10 is a side elevational view of the detail of FIG. 9, with the percussing wedge extended.

The accommodation of nozzle assembly 7 and breaking tool 8 having the shape of a percussing wedge 8*a* or of a pivotal wedge 8*b* in the cutting and breaking head 8 is shown in FIGS. 8 through 13. FIGS. 8 to 10 show a cutting and breaking head 4 which is designed symmetrically, but is otherwise conformable to the head 3, and which comprises a housing 9 accommodating the nozzle assembly 7 and percussing wedge 8*a* with an actuating element 11 and the guiding element 10 thereof. FIGS. 8 and 9 show percussing wedge 8*a* in its retracted position, and FIG. 10 shows wedge 8*a* in its extended position.

Figure 11:
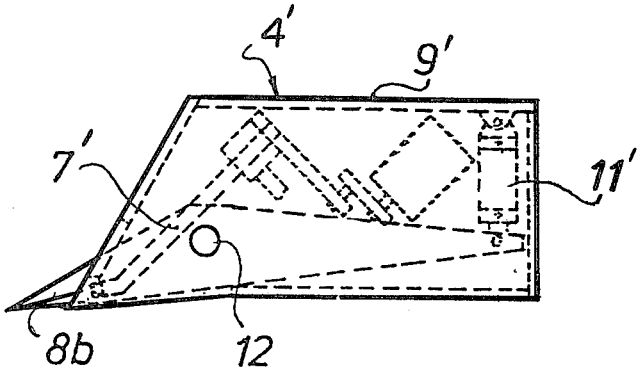
FIG. 11 is a top plan view of a detail indicated by arrow XI in FIG. 5, showing the cutting and breaking head with a pivotal wedge in a swung-in position.
Figure 12:
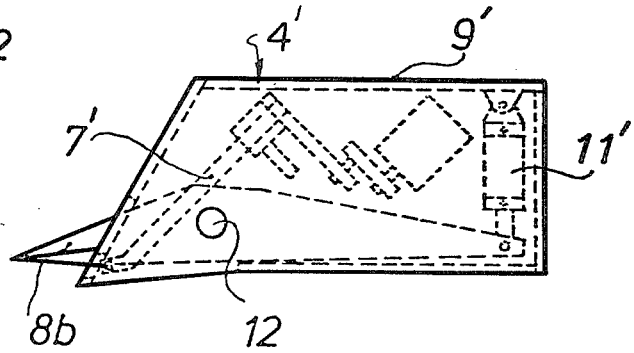
FIG. 12 is a detail of FIG. 11, with the wedge in its swung-out position.
Figure 13:
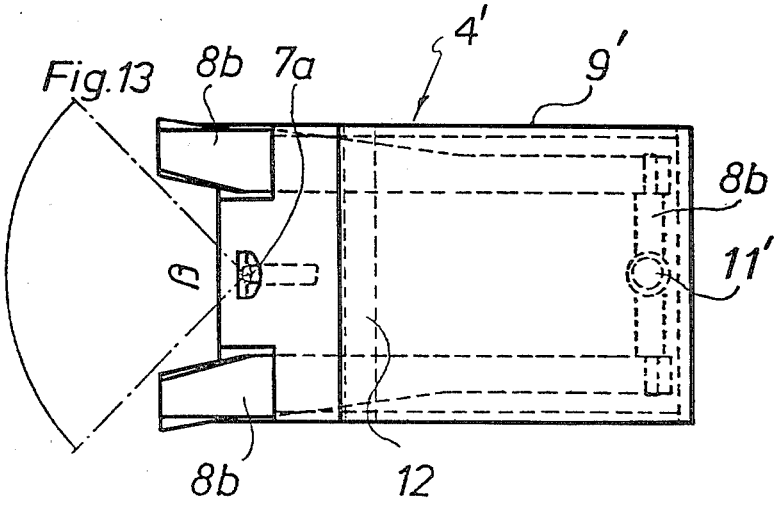
FIG. 13 is a side elevational view of the detail of FIG. 12, in which the pivotal wedge is swung out.

FIGS. 11 to 13 show another embodiment of a cutting and breaking head 4' having a housing 9' containing a nozzle assembly 7' and pivotal wedge 8*b* which is provided with an actuating element 11' and is pivotable about an axis 12. In FIG. 11, pivotal wedge 8*b* is shown in its swung-in position, and in FIGS. 12 and 13, the wedge is shown in its swung-out position.

Figure 14:
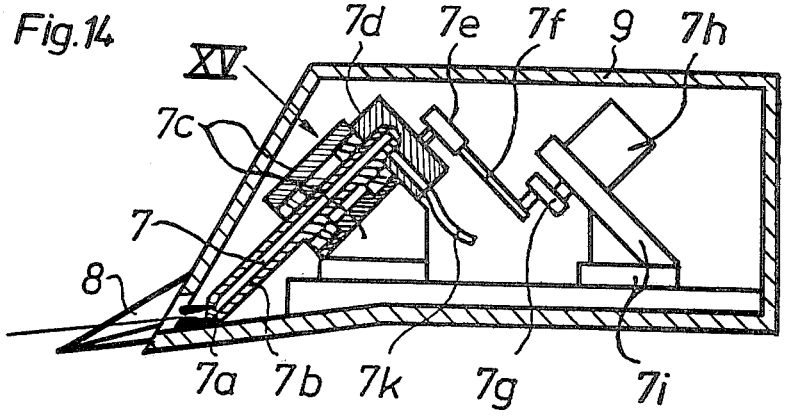
FIG. 14 is a top plan view of a detail indicated by arrow XIV of FIG. 8, showing the nozzle assembly in a cross-sectional view.
Figure 15:
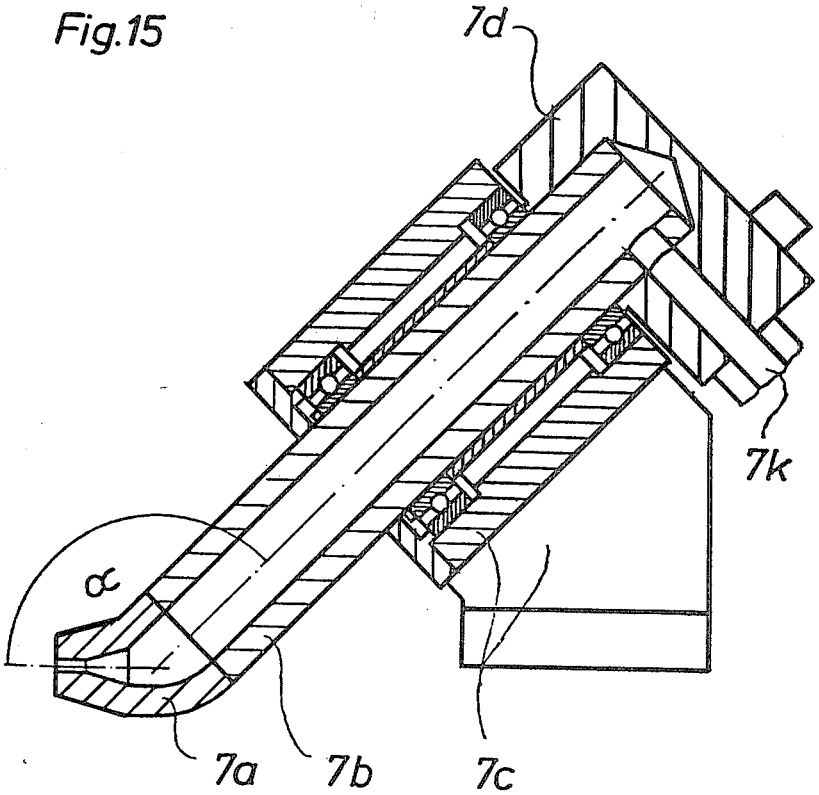
FIG. 15 shows the detail indicated by arrow XV in FIG. 14.
Figure 16:
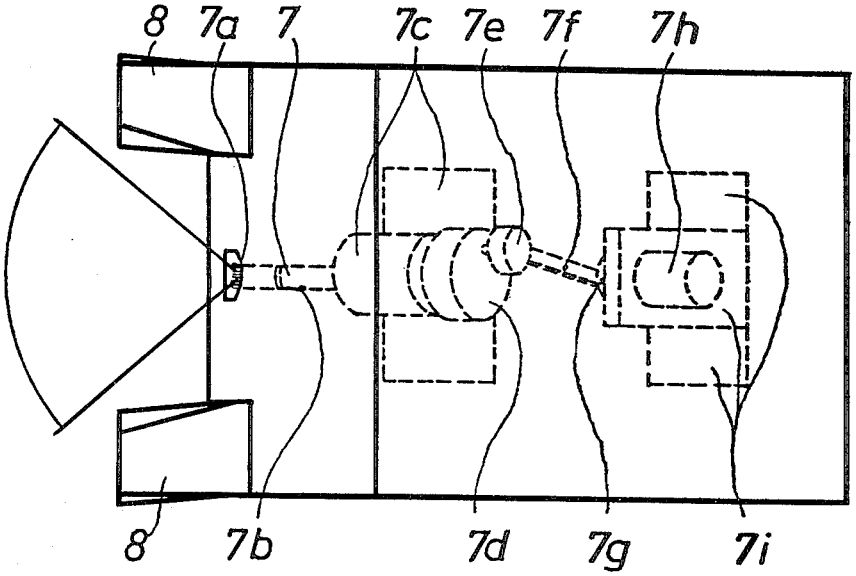
FIG. 16 is a view similar to FIG. 14, showing the nozzle assembly in a side elevational view, in perspective representation.

The individual component parts of nozzle assembly 7 are shown in FIGS. 14 through 16. As shown in FIGS. 14 to 16, this assembly comprises a nozzle 7*a* secured to a swivel pipe 7*b*, a displacement mounting 7*c* for swivel pipe 7*b*, a connecting element 7*d* provided between the swivel pipe and its drive, a coupling element 7*e* mounted thereon and located at the side of the swivel pipe, a coupling rod 7*f*, a coupling element or crank 7*g* located at the side of the drive, swivel drive 7*h* with a displacement member 7*i*, and a liquid feed conduit 7*k*.

Due to the swiveling motion of swivel pipe 7*b*, the extreme-pressure liquid jet of nozzle 7*a* shears an undercut in mineral 60 (FIGS. 17 and 18) in the vertical direction and within the range of an angle $\beta$ of 90° to less than 180°, as shown in FIG. 13, and thus, makes the incisions 6 and 6*a*. This is effected due to the provision that the axis of nozzle 7*a* which is secured to swivel pipe 7*b* forms with the longitudinal axis of swivel pipe 7*b* an angle of inclination $\alpha$ of from 90° to less than 180°, as shown in FIG. 15. The liquid pressure at nozzle 7*a* necessary for the desired effect of the liquid jet is maintained by the control mechanism of the pump.

The partial operation of the breaking off of mineral 1*a* from the face follows the undercutting and is performed by means of a percussing wedge 8*a* executing striking movements or by means of a pivotal wedge 8*b* executing pivotal movements. By means of the mining machine 2, it is also possible to appropriately adjust and maintain the desired thickness of the mineral slab to be dislodged, i.e., the advance of workings in the direction 1*b* and also the position in height of cutting and breaking heads 3 and 4 between the roof and the floor.

Figure 17:
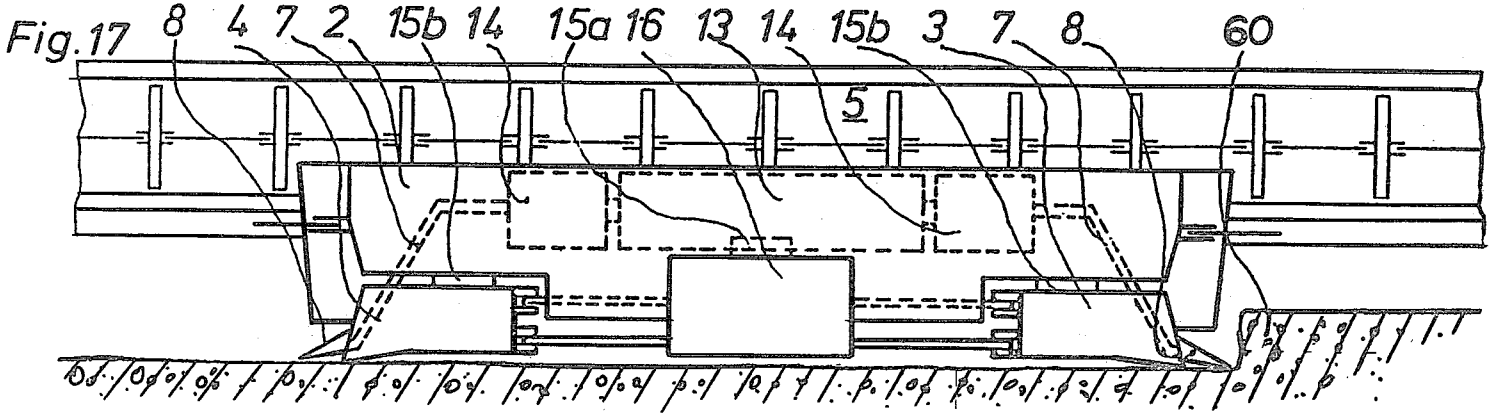
FIG. 17 is a view similar to FIG. 1 showing the mining machine with a retracted advance element.
Figure 18:
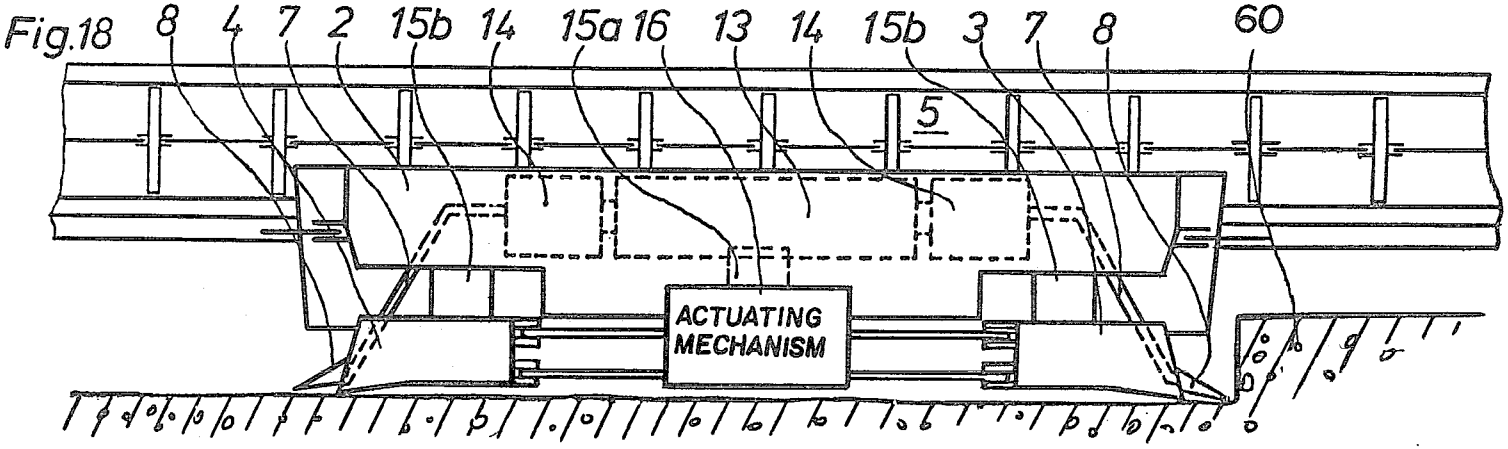
FIG. 18 is a view similar to FIG. 17, with the advance element extended.

As shown in FIGS. 17 and 18, the depth of the cutting step in the face is adjusted by means of an actuating mechanism 16 provided in the mining machine 2, by which horizontally shiftable advance elements 15*a* and 15*b* are moved in the direction 1*b* and held in the desired position. FIG. 17 shows advance elements 15*a* and 15*b* in their retracted position, and FIG. 18 shows these elements in their extended position.

Actuating mechanism 16 also performs another function, namely, of moving cutting and breaking heads 3 and 4 to the fitting level between the roof and the floor and of holding them in the desired position.

Figure 19:
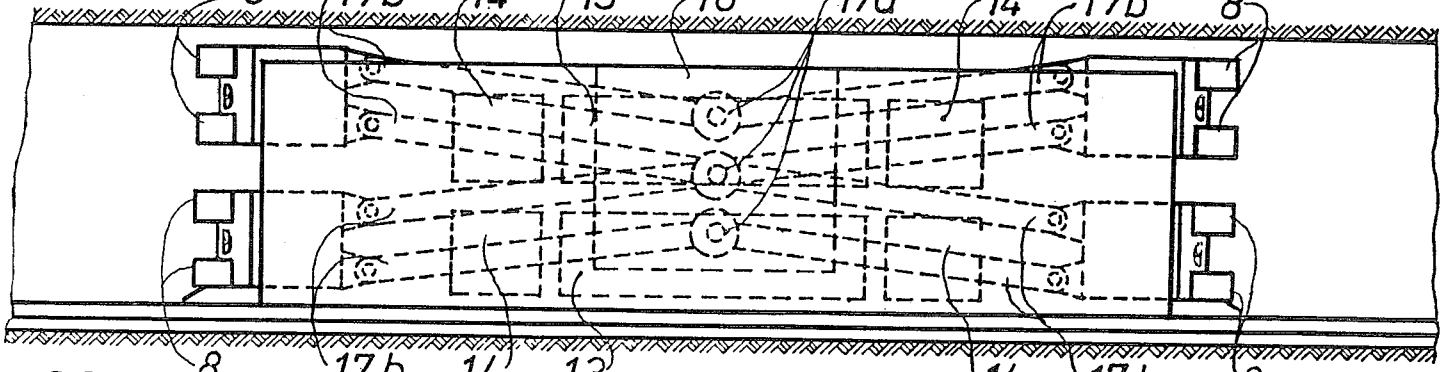
FIG. 19 is a view similar to FIG. 16, showing a doubledeck design of the mining machine, with the cutting and breaking heads provided at both levels and the height-adjusting elements retracted.
Figure 20:
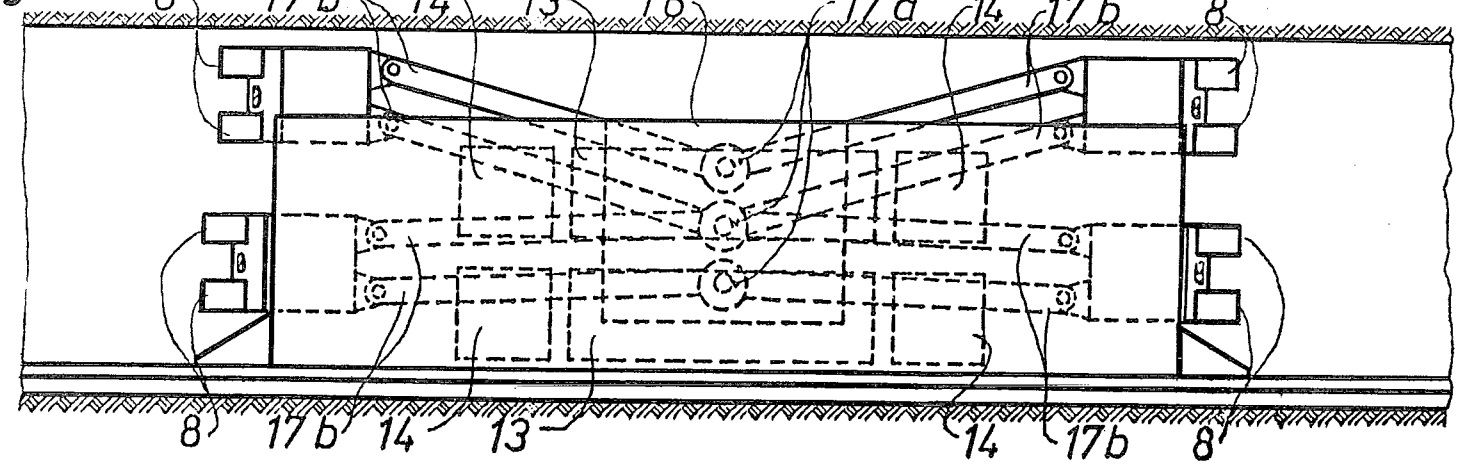
FIG. 20 is a view similar to FIG. 19, with the height-adjusting elements extended.

This motion is executed by adjusting elements 17*a* and 17*b* which are shown in FIGS. 19 and 20 and are extended and retracted by actuating mechanism 16. FIG. 19 shows adjusting elements 17*a* and 17*b* in their retracted position, and FIGS. 20 shows them in their extended position.

While specific embodiments of the invention have been shown and described in detail to illustrate the applicationof the principles of the invention, it will be understood that the invention may be embodied otherwise without departing from such priciples.

What is claimed is:

1. A method of mining particularly hard mineral raw materials using a pivotal fluid pressure jet and a percussion device for undercutting the mineral comprising undercutting the mineral by directing the high pressure fluid jet without interruption at an even rate in the mining direction while swinging the jet upwardly and downwardly in a vertical plane lying at an acute angle to the face being mined and directing the percussion instrument so as to mine away the mineral of a selected thickness in coordination with the action of the fluid jet by engaging the percussion instrument in the mineral and performing pivotal motions in a horizontal plane and following the action of the percussion instrument with the fluid jets to break away the minerals engaged by the percussion tool.

2. A method of mining, as claimed in claim 1, including continuously carrying away the material while is broken off and wherein the material is continuously extracted by carrying out the undercutting of the material continuously with an adjustable lead over the breaking off of the slab.

3. A method of mining, as claimed in claim 1, wherein, during the undercutting, the pressures of the liquid jet against the face are adjusted in accordance with the hardness of the material being removed.

4. A method of mining, as claimed in claim 1, wherein the material is undercut by means of a single nozzle for an extreme-pressure liquid.

5. A method of mining, as claimed in claim 1, wherein the undercutting is carried out by means of a plurality of nozzles directed against the face of the mine.

6. A method of mining, as claimed in claim 1, wherein the wedge-shaped percussion tool is moved by pivotal forceful movements.

7. A method of mining, as claimed in claim 1, wherein the material is carried away from the undercutting in a single direction.

8. A method of mining, as claimed in claim 1, wherein the material is continuously carried off in two directions away from the undercutting.

9. A method of mining, as claimed in claim 1, wherein the undercutting is carried out at a single deck location when there is a mineral deposit of small thickness.

10. A method of mining, as claimed in claim 1, wherein, when there is a mineral occurring in a deposit of greater thickness, the undercutting is carried out at more than one level.

11. A method of mining, as claimed in claim 1, wherein, during the undercutting of the mineral, the pressure of the liquid directed against the face to effect the undercutting is controlled such that the mineral material is maintained in a condition at which it will not ignite.

12. A method of mining, as claimed in claim 1, including directing the liquid at a rate to ensure that no dust forms.

13. A method of mining, as claimed in claim 1, wherein, during undercutting, the thickness of the slab is adapted to the desired coarseness of the extracted material.

14. A method of mining, as claimed in claim 1, wherein the liquid is directed at a rate so that the water content of the removed materials does not exceed a predetermined value.

15. Apparatus for cutting away hard mineral deposits of a running face of a mine, comprising, a machine housing adapted to be moved along the face, at least one impact head mounted on said housing for movement toward and away from the running face and to and fro along the running face, a percussion member of wedge-shaped configuration on said head, mounting means mounting said percussion member on said head for movement relative to said including feeding elements for moving said percussion member forwardly in a substantially horizontal direction and adjusting elements for extending and retracting said percussion member in a substantially vertical direction, a nozzle assembly carried by said head for pivotal movement upwardly and downwardly in a substantially vertical plane and having a nozzle discharge for discharging a liquid at high pressure against the mining face in advance of said head to undercut the face, nozzle pivoting means for pivoting said nozzles upwardly and downwardly, drive means for driving said percussion member to move it into the undercutting with a force to break away the material thereover.

16. Apparatus, as claimed in claim 15, including control means for operating said nozzle discharge and for operating the movement of said percussion member so that said nozzle is operated to discharge a liquid spray ahead of movement of said percussion member.

17. Apparatus, as claimed in claim 15, including means connected to said swivel pipe for supplying liquid at an adjustable pressure.

18. Apparatus, as claimed in claim 15, wherein said percussion member comprises a pivotal wedge mounted on said head for pivotal movement.

19. Apparatus, as claimed in claim 15, including at least one additional breaking head mounted on said housing for movement in the same manner as said first head but in an opposite direction in respect thereto for engaging the face in an opposite direction from said first head, an actuating mechanism connected to said heads for moving said heads relative to said housing, and adjusting means for adjusting the location of said heads in respect to height of positioning relative to said mining face.

20. Apparatus for cutting away hard mineral deposits of a running face of a mine, comprising a machine housing adapted to be moved along the face, at least one impact head mounted on said housing for movement toward and away from the running face and to and fro along the running face, a percussion member of wedge-shaped configuration on said head, mounting means mounting said percussion member on said head for movement relative to said head, a nozzle assembly carried by said head and having a nozzle discharge for discharging a liquid at high pressure against the mining face in advance of said head to undercut the face, drive means for driving said percussion member to to move it into the undercutting with a force to break away the material thereover, said nozzle assembly comprising a swivel pipe having an end directed toward the face with a nozzle secured thereto, means in said head mounting said swivel pipe for swiveling movement in a substantially vertical plane, drive means connected to said pipe to swivel said pipe, and means for conducting a liquid into said pipe for discharge out through said nozzle.

21. Apparatus, as claimed in claim 20, wherein the axis of said nozzle forms with a longitudinal axis of the swivel pipe an angle of inclination of from 90° to 180°.

* * * * *